United States Patent [19]

Schnell

[11] Patent Number: 4,722,076

[45] Date of Patent: Jan. 26, 1988

[54] ARRANGEMENT FOR LIMITING THE AXIAL PLAY OF GEARS OF A WATCH TIME INDICATING MECHANISM

[75] Inventor: Hans-Georg Schnell, Keltern, Fed. Rep. of Germany

[73] Assignee: Pforzheimer Uhren-Rohwerke PORTA GmbH, Pforzheim, Fed. Rep. of Germany

[21] Appl. No.: 12,184

[22] Filed: Jan. 30, 1987

[51] Int. Cl.[4] ..... G04B 19/02; G04B 29/00

[52] U.S. Cl. ..... 368/220; 368/318; 368/319

[58] Field of Search ..... 368/76, 80, 88, 185, 368/190–199, 220, 318, 319, 320, 322–324

[56] References Cited

U.S. PATENT DOCUMENTS

| | | | |
|---|---|---|---|
| 540,874 | 6/1895 | Porter | 368/191 |
| 613,411 | 11/1898 | Donneut | 368/319 |
| 632,128 | 8/1899 | Krahenbuitl | 368/318 |
| 4,496,246 | 1/1985 | Ota et al. | 368/220 |

*Primary Examiner*—Vit W. Miska

[57] ABSTRACT

In an arrangement for limiting the axial play of gears of a watch time indicating mechanism with drive gears rotatably supported on a support plate with axis extending normal thereto and an adjustment shaft extending parallel to the support plate, a cover plate is mounted on the support plate so as to overlay the gears with arms engaging the gears and further is provided with an arm bent-over into engagement with the adjustment shaft to limit their axial play. The cover plate is U-shaped and has edge portions thereof resiliently received under projections of the support plate for firmly retaining the cover plate on the support plate.

8 Claims, 2 Drawing Figures

II
II
22
24
23
21
16
19
3
28
30
32
34
36
26
29
31
33
35
14
2
12
18
25
7
11
27
18
15
13
18
17

18
7
6
8
21
22
26
37
33
17
12
4
5
1
2
9
10
3
20
19

ARRANGEMENT FOR LIMITING THE AXIAL PLAY OF GEARS OF A WATCH TIME INDICATING MECHANISM

BACKGROUND OF THE INVENTION

The invention relates to an arrangement for limiting the axial play of a number of gears of a watch drive mechanism and also of the time adjustment shaft of the watch.

The various gears of the indicating mechanism of a small watch are rotatably supported on studs or shafts immovably mounted on a mounting plate on which the gears are also axially movable. Also, the time adjustment shaft of a small watch is axially movably supported by a slide bearing. Axial play of the gears of the indicating mechanism is limited at the side of the support plate by means of stops provided on the support plate, which stops are engaged by a sleeve or a rim associated with the gear. In opposite direction, axial play of the gears is limited in accordance with prior art arrangements by mounting a bridge member on the support plate which bridge member is abutted also by a sleeve or a rim associated with the gear. Also known is the provision of a bridge plate which is screwed onto the support plate and provides a stop structure for a number of gears of the indicating mechanism, that is, a structure which combines the functions of a number of bridge members. The axial play of the adjustment shaft on the other hand is generally limited by way of a spring arm which projects into a groove associated with the adjustment shaft.

The bridge members as well as an appropriate bridge plate and also the spring arm projecting into the adjustment shaft groove need to be manufactured and mounted onto the support plate with high accuracy. This requires not only a relatively high manufacturing effort but also results in relatively difficult and tedious assembly steps which, generally, cannot be performed by automatic manufacturing equipment. As a result of such tedious assembly and the impossibility to perform the assembly automatically, assembly of such small watches is relatively expensive.

It is therefore the object of the present invention to provide an arrangement for limiting the axial play of certain gears and shafts of a watch time indicating mechanism which is relatively simple to manufacture and with which assembly of the watch is facilitated to such a degree that assembly by means of automatic manufacturing equipment is possible.

SUMMARY OF THE INVENTION

An arrangement for limiting the axisl play of gears of a watch time indicating mechanism in which drive gears are rotatably supported on a support plate with their axes extending normal to the support plate and wherein a hand adjustment shaft is supported parallel to the support plate, includes a cover plate which is mounted on the support plate so as to extend over the gears with arms engaging the gears and a bent-over arm engaging the hand adjustment shaft to limit their axial play.

Preferably the cover plate is U-shaped and is received in a corresponding cavity in the support plate with legs which can be compressed for insertion of the cover plate into the cavity and under projections extending from the edge of the cavity over the cover plate when the legs are released into proper position in the cavity for mounting the cover plate onto the support plate.

With the arrangement according to the invention, the axial play of the various gears is no longer controlled by various bridge members or by a bridge plate which form stop members for abutment of the sleeves or rims associated with the gears but by a single cover plate which extends over the whole indicating gear structure and which provides for stops for all the gears and, at the same time, has integral therewith a structure which also engages the adjustment shaft to provide appropriate axial stops. Since the cover plate is essentially flat and simply abuts the gear mounting plate, it is easily manufactured accurately and easily mounted properly; that is, no precision manufacturing is required and proper positioning is facilitated to such a degree that assembly by automatic equipment becomes possible. With the same assembly step the axial play of the adjustment shaft is also attended to so that no separate assembly step is necessary for this especially tedious procedure. In order to permit checking and adjusting the position of the cover plate, the cover plate is preferably U-shaped and has inwardly projecting arms for abutment with the gears of the indicating gears and for engagement with the adjusting shaft. Preferably such a cover plate consists of spring-type plate material.

In order to provide for proper seating of the cover plate, the gear support plate may be provided with positioning pins projecting therefrom into engagement with the cover plate or the support plate may also have a cavity corresponding in size to the size of the cover plate in which cavity the cover plate is received. This further facilitates automatic assembly since the cover plate may then simply be placed onto the positioning pins and/or into the cavity in the support plate whereby the proper position of the cover plate is insured.

It is noted however that not only the position of the cover plate may be insured in this manner but the cover plate may also be secured to the mounting plate in a simple manner by providing projections at the head of the positioning pins or at the edges of the walls defining the support plate cavities which projections extend over the cover plate after it is properly positioned in place and which projections engage and retain the cover plate in position. The insertion and mounting of the cover plate and also its removal is greatly simplified in this manner. Screw connections are no longer necessary. The insertion, proper positioning and mounting steps can easily be performed by automatic manufacturing equipment--an important consideration in today's economy.

With the U shape of the cover plate the free arms of the cover plate can be resiliently pressed together in order to permit insertion thereof into the cavity in the support plate such that, upon release thereof, the edges of the cover plate will extend below the projections at the side walls of the cavity such that the cover plate will then be firmly retained in the cavity. If pins with projections at their heads are utilized, the cover plate may simply be placed over the pins such that the pins project through elongated openings therein whereupon the cover plate is moved laterally to properly snap into position in the cavity in the support plate. Such a U-shaped cover plate is preferably provided with openings in the free arms thereof so that the cover plate can be engaged and its arms can be compressed resiliently by the fingers of an automatic manufacturing tool.

SHORT DESCRIPTION OF THE DRAWINGS

FIG. 1 is a top view of a watch operating mechanism with a cover plate shown in place; and FIG. 2 is a cross-sectionsl view along line II—II of FIG. 1.

DESCRIPTION OF A PREFERRED EMBODIMENT

Figure 1:
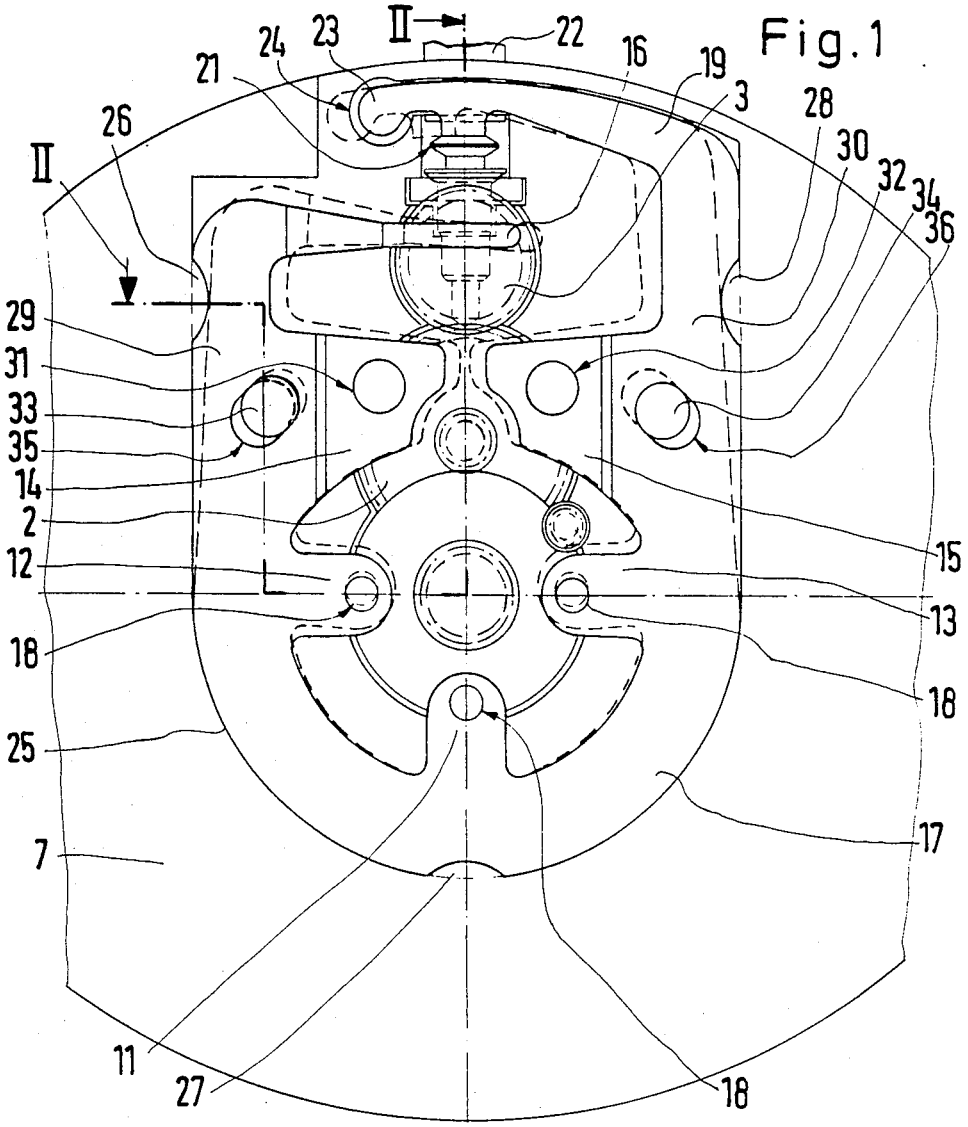
Figure 2:
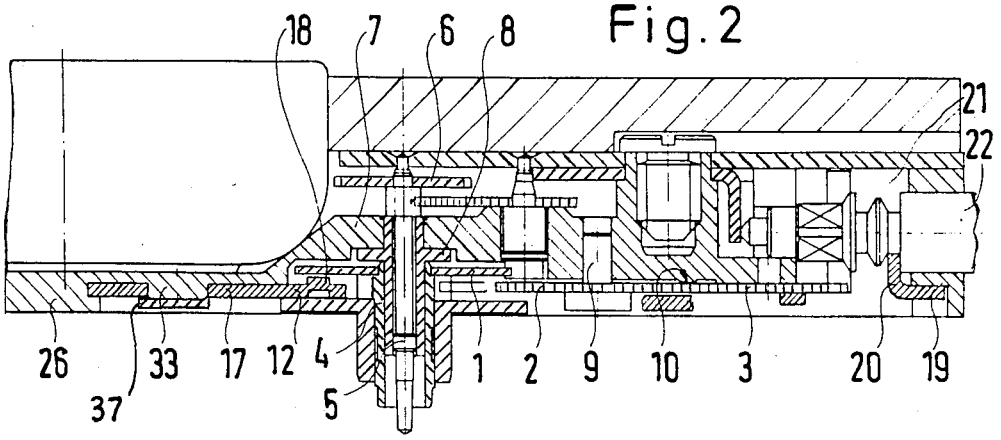

The gears of the indicator drive mechanism of a small watch, whose axial play is to be limited, are the minute gear 1, the change-over gear 2 and the adjusting gear 3. The minute gear 1 is mounted on a sleeve 4 which is supported on the shaft 5 of the second gear 6. Axial play of the sleeve 4 toward the support plate 7 is limited by way of a collar 8 which abuts the support plate 7. The change-over gear 2 is rotatably supported by the support plate 7 by way of a journal pin 9. Its axial play toward the support plate 7 is limited by way of a projection 10 formed from the support plate 7. The adjusting gear 3 is supported on the support plate 7 and its axial play is limited in the same manner. In the opposite direction the axial play of the gears is limited by projecting arms 11, 12, 13, 14 and 15 and the axial play of the adjustment shaft is limited by a projecting arm 16 which arms extend from a U-shaped cover plate 17.

For a reduction of the area of engagement with the gears the projecting arms 11, 12, 13, 14, 15 are preferably provided with nubs 18.

Since, in accordance with the arrangement of the invention, the cover plate 17 preferably is a spring plate, the projecting arms 11, 12, 13, 14, 15 and the arm 16 are somewhat resilient so that they retain the gears and shafts resiliently, thereby avoiding damage to the drive mechanism even when the watch is subject to relatively large shocks.

Another retaining arm 19 provided with a bentover section 20 extends into the groove 21 of the gear adjustment shaft 22. At its free end the retaining arm 19 carries a flat head section 23 which facilitates pressing the section 20 into engagement with the gear adjustment shaft 22.

The support plate 7 has a cavity 25 formed therein which in size corresponds to the size of the cover plate 17. At the circumference of the cavity 25 there are provided projections 26, 27, 28 which extend over the cover plate 17 when the cover plate 17 is inserted into the cavity 25 and which firmly retain the cover plate 17 in the cavity 25. For the insertion of the cover plate 17 into the cavity 25, the legs 29, 30 of the U-shaped cover plate 17 are comprssed by means of a tool, for example, by tweezers which are inserted into the holes 31, 32 in the cover plate. The bow portion of the cover plate 17 is first moved under the projection 27 and the legs 29, 30 are then placed under the projections 26 and 28 by releasing the legs 29, 30. The final position of the cover plate 17 is determined by abutment of the retaining arm 19 with the side walls of the cavity 25 but also, if provided, by mounting pins 33, 34 which are received in elongated holes 35, 36 in the cover plate 17 and preferably have collars 37 extending over the cover plate 17. The shape of the U-shaped cover plate 17 with the legs 29, 30 compressed is shown in FIG. 1 in dashed lines.

For the removal of the cover plate 17 it is merely necessary to insert a tool into the openings 31, 32 in the legs 29, 30 and compress the legs. The cover plate 17 may then be easily lifted out of the cavity 25 from underneath the projections 26, 27 and 28.

Mounting of the cover plate but also its removal is therefore greatly facilitated and can easily be done by automatic manufacturing equipment.

What is claimed is:

1. An arrangement for limiting the axial play of gears of a watch time indicating mechanism, which gears are all rotatably supported on a support plate, said gears including drive gears with axes extending normal to said support plate and also an adjustment shaft with a gear having an axis extending in a plane normal to the axis of said drive gears, said arrangement including a cover plate mounted on said support plate and overlaying said drive gears, said cover plate abutting said drive gears so as to limit their axial play and having a retaining arm provided with a section bent-over to extend into engagement with said adjustment shaft so as to limit axial movement of said adjustment shaft.

2. An arrangement according to claim 1, wherein said cover plate consists of a spring plate.

3. An arrangement according to claim 1, wherein said cover plate is U-shaped so as to form legs which have inwardly projecting resilient arms which abut said gears and engage said adjustment shaft.

4. An arrangement according to claim 1, wherein said support plate has formed therein a cavity sized and shaped so as to correspond to said cover plate and receiving said cover plate.

5. An arrangement according to claim 4, wherein projections are provided at the edges of said cavity, said projections extending from said support plate over said cover plate so as to firmly retain said cover plate in position within said cavity.

6. An arrangement according to claim 4, wherein said cover plate has guide openings and said mounting plate has positioning pins extending therefrom and received in said guide openings.

7. an arrangement according to claim 6, wherein said positioning pins are provided with collars partially projecting over said cover plate.

8. An arrangement according to claim 5, wherein the legs of said U-shaped cover plate are provided with openings adapted to receive a tool permitting compression of the legs for insertion of the cover plate under the projections of said support plate.

* * * * *